US005497144A

United States Patent [19]

Schäppi et al.

[11] Patent Number: 5,497,144

[45] Date of Patent: Mar. 5, 1996

[54] TESTING AND ADJUSTMENT OF SCATTERED-LIGHT SMOKE DETECTORS

[75] Inventors: Hans-Peter Schäppi, Zürich; Arthur Hidber, Esslingen, both of Switzerland

[73] Assignee: Cerberus AG, Maennedorf, Switzerland

[21] Appl. No.: 187,650

[22] Filed: Jan. 27, 1994

[30] Foreign Application Priority Data

Jul. 7, 1993 [CH] Switzerland ..... 2037/93

[51] Int. Cl.[6] ..... G08B 17/10

[52] U.S. Cl. ..... 340/630; 340/628; 340/514; 340/515; 250/574

[58] Field of Search ..... 340/630, 628, 340/514, 515; 252/305; 250/574, 573

[56] References Cited

U.S. PATENT DOCUMENTS

| | | | |
|---|---|---|---|
| 3,585,621 | 6/1971 | DiCelio | 340/515 |
| 4,099,178 | 7/1978 | Ranney et al. | 340/515 |
| 5,309,148 | 5/1994 | Birk | 340/628 |

FOREIGN PATENT DOCUMENTS

| | | |
|---|---|---|
| 8524914 | 10/1986 | Germany . |
| 53-99899 | 2/1977 | Japan . |
| 1079929 | 8/1967 | United Kingdom . |
| 2251067 | 6/1992 | United Kingdom . |

*Primary Examiner*—Brent A. Swarthout
*Assistant Examiner*—Julie B. Lieu
*Attorney, Agent, or Firm*—Brumbaugh, Graves, Donohue & Raymond

[57] ABSTRACT

For testing or/and adjusting a scattered-light smoke detector as to sensitivity to smoke, a transparent body with included scattering centers is introduced into the measurement volume of the detector. Aluminum oxide powder particles can serve as scattering centers. The distribution of light scattering centers is preferably uniform, and their concentration chosen to simulate a smoke density corresponding to the alarm threshold of the smoke detector. Thus, scattered-light smoke detectors are readily calibrated to a desired output signal as a function of smoke density. With a different density of scattering centers, the technique can be used for testing scattered-light smoke detectors in the field. If the scattering centers are distributed outside a measurement volume of an uncontaminated detector, the technique can be used for testing as to contamination.

16 Claims, 2 Drawing Sheets

TESTING AND ADJUSTMENT OF SCATTERED-LIGHT SMOKE DETECTORS

BACKGROUND OF THE INVENTION

The invention relates to scattered-light smoke detectors.

Smoke detectors involving sensing of optical properties of combustion aerosols are in common use, especially as based on scattered-light principles. Such detectors are suited for early-warning fire detection, for timely fire-fighting intervention.

For reliability of response, the sensitivity of fire detectors must lie within a certain tolerance interval, typically as prescribed by technical standards or regulations. Accordingly, it is important to provide means for adjusting the sensitivity of scattered-light smoke detectors.

A scattered-light smoke detector includes a light source, typically for emitting light pulses into a spatial region of the detector accessible to combustion aerosols. In the spatial region, light from the source is scattered by the combustion aerosols. Included further is a light sensor which is designed and disposed to detect light from a spatial subregion. This subregion may be called measurement volume.

In the interest of preventing light from reaching the sensor in the absence of smoke, elaborate light traps or baffles are included for shielding the sensor against spurious influences, mainly from dust particles on surfaces of the spatial region. But even in a pristine detector, no matter how elaborately designed, a small amount of light will be reflected from these surfaces, resulting in a base-level signal.

An electrical signal produced by the scattered light in analyzed in an evaluation circuit, and, if a sensor output signal exceeds a predetermined threshold, an alarm signal is triggered. Scattered-light smoke detectors of this type are described in numerous patent documents, e.g., GB-A-2,251,067 and DE-G-8,524,914.

Typically, the sensitivity of scattered-light smoke detectors is set in the course of manufacture. According to a frequently employed method, scattered-light smoke detectors are placed in a chamber or passage which can be filled with a test aerosol having known composition and concentration. Upon adjustment of this concentration to an alarm concentration, the sensitivity of the detector is set by appropriate adjustment of the alarm threshold, for production of an alarm signal at predetermined smoke concentration.

This method of adjustment has significant drawbacks, impeding manufacture. For one thing, it is difficult to produce a calibration aerosol with controlled concentration. For another, the method is time consuming. In fact, the adjustment step including production and control of the calibration aerosol is determinative of the rate of assembly. To achieve assembly rates as are expected in modern assembly line production, several smoke calibration installations have to be operated in parallel, with attendant high requirements of uniformity of control.

In an alternative method, without use of smoke for calibration, the above-mentioned base-level reflection is used as a reference. From a reference signal produced by the base-level reflection, a suitably higher signal value is chosen as the alarm threshold value. While this method of calibration is considerably faster, it has a decided drawback in requiring a high degree of constancy of the base-level reflection, i.e., of the physical properties of delimiting surfaces. The optical trap must be built to such high standards that the rejection rate and thus the manufacturing costs are high. This is one of the reasons why most detector manufacture still involves calibration with smoke, in spite of greater complexity.

Mainly, however, use of the base-level reflection as calibration reference has the drawback of not offering a true simulation of an aerosol, and thus of not representing a physically adequate alternative to calibration with smoke of known concentration.

Scattering of light by smoke particles is a volume effect, i.e., the scattered light received by the sensor is the sum total of many individual scattering processes in the measurement volume. By contrast, base-level reflection is a surface effect. Light reaching the sensor originates on interior detector surfaces and varies depending on the properties of these surfaces. There is no simulation of the physical effect for which the detector is designed, and detectors "calibrated" by this method cannot be expected to have uniform sensitivity to smoke. The ability of a detector to sense the presence of light-scattering particles in the measurement volume remains untested.

Other methods are known which involve insertion of a test object into the measurement volume of a scattered-light smoke detector. Such a method is described in Japanese Patent Document JP-53-99899, disclosing insertion of a needle shaped object into the measurement volume from the outside for testing of the detector.

According to the disclosure of British Patent Document GB-1,079,929, the presence of smoke is simulated by insertion of a flag into the measurement volume.

U.S. Pat. No. 3,585,621 discloses a functional test, involving placement of a calibration object opposite the light source, having a reflectivity corresponding to the scattering by smoke of a given density. Here again, simulation is not realistic, as light is merely reflected from the surface of the object rather than scattered by many particles as in the case of smoke.

U.S. Pat. No. 4,099,178 discloses a test setup which provides for primary light from the light source to pass through a small opening in the light trap directly to the sensor. No realistic simulation of scattering by a plurality of particles is achieved, and the technique is only conditionally suited for functional testing of a detector, as the intensity of light reaching the sensor is larger by magnitudes as compared with scattered radiation from combustion aerosols.

Neither of these calibration techniques is sufficiently accurate to replace calibration with an aerosol.

SUMMARY OF THE INVENTION

Without requiring an aerosol such as smoke of known concentration, scattered-light smoke detectors are adjusted or calibrated with enhanced accuracy for smoke detection. Light scattering centers are included in a body of material which is transparent to radiation, and this body is introduced into the measurement volume of a detector to be adjusted, for scattering centers to be present in at least a portion of the measurement volume. This presence of light scattering centers may be interpreted as simulating the presence of an aerosol.

The distribution of light scattering centers is preferably uniform, and their concentration chosen to simulate a smoke density corresponding to the alarm threshold of the smoke detector. With a different density of scattering centers, the technique can be used for testing scattered-light smoke detectors in the field. If the scattering centers are distributed outside a measurement volume of an uncontaminated detector, the technique can be used for testing detectors as to contamination.

DETAILED DESCRIPTION OF PREFERRED EMBODIMENTS

Figure 1:
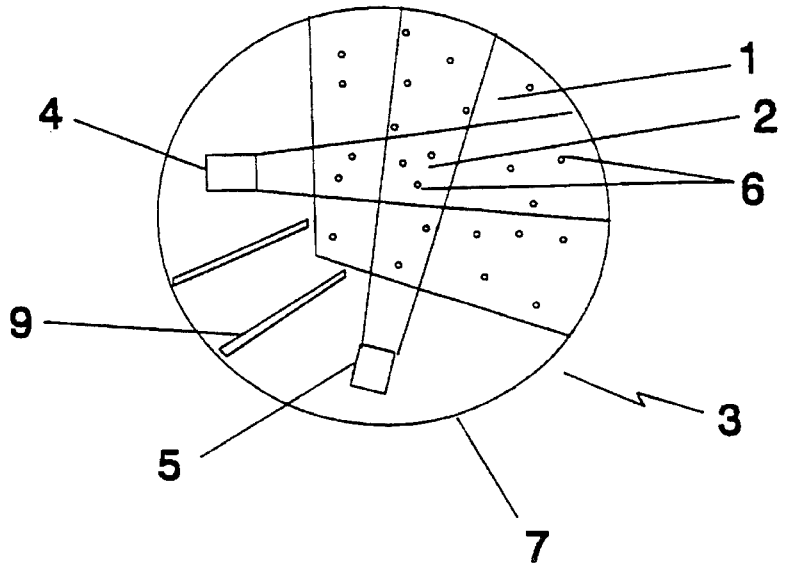
FIG. 1 is a schematic cross section of a scattered-light smoke detector with a test body in the measurement volume, for testing, adjustment or calibration of sensitivity in accordance with a preferred embodiment of the invention.

In cross section, FIG. 1 shows a test body 1 in the measurement volume 2 of a scattered-light smoke detector 3. The measurement volume 2 is shown as delimited (i) by rays from the light source and (ii) by the field of vision of the sensor 5.

In a preferred embodiment, the test body 1 consists of silicone rubber (e.g., Dow Corning dielectric silicone gel 3-6527 A&B) in which aluminum oxide particles 6 having a nominal size of 30 μm are uniformly distributed and firmly encased.

Figure 2:
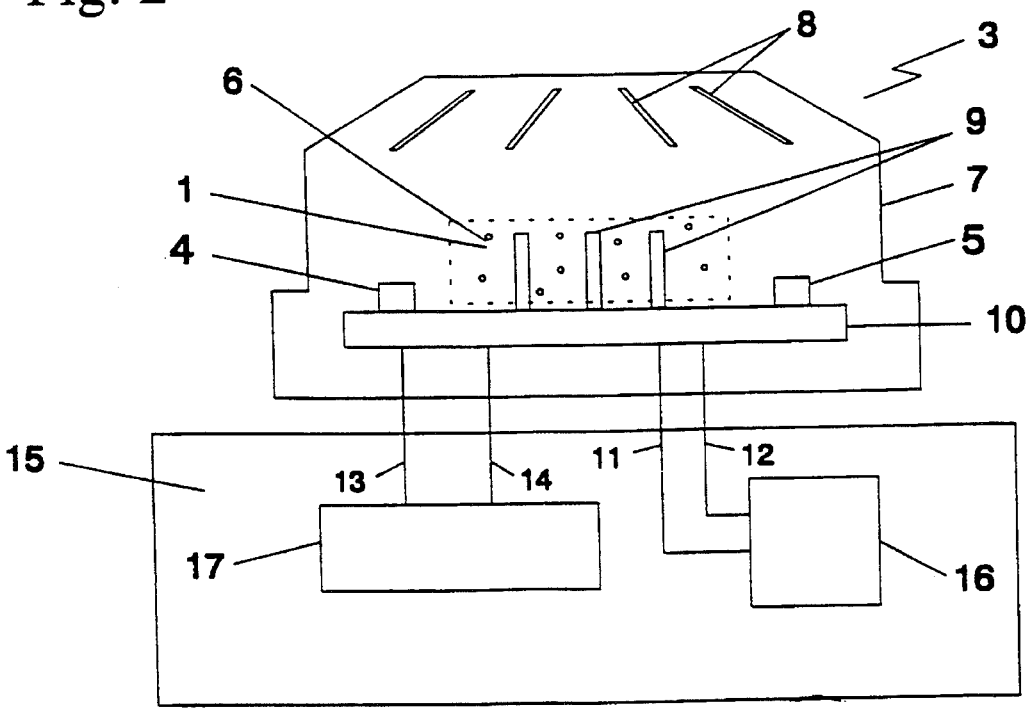
FIG. 2 is a diagrammatic representation of apparatus for testing, adjustment or calibration of a scattered-light smoke detector in accordance with a preferred embodiment of the invention.

The apparatus shown in FIG. 2 includes a housing 7 with smoke inlets 8, a light source 4, a light sensor 5, and an optical trap 9. Electronic evaluation circuitry 10 is connected to an adjustment device 15 via lines 11, 12, 13 and 14. The lines 11 and 12 are power lines from a power source 16. The lines 13 and 14 connect the scattered-light smoke detector with electronic evaluation/adjustment circuitry 17. Line 13 carries the detector signal produced upon introduction of a test body as described above. Line 14 is for control of the electronic evaluation circuitry 10.

In accordance with a preferred method of the invention, adjustment of a scattered-light smoke detector 3 first involves a determination of relevant detector parameters. A test body 1 is introduced as described, producing scattered light corresponding to smoke at alarm density. A corresponding signal is transmitted to the electronic evaluation circuitry 17, for setting of the smoke sensitivity or alarm threshold of the scattered-light smoke detector.

Figure 3:
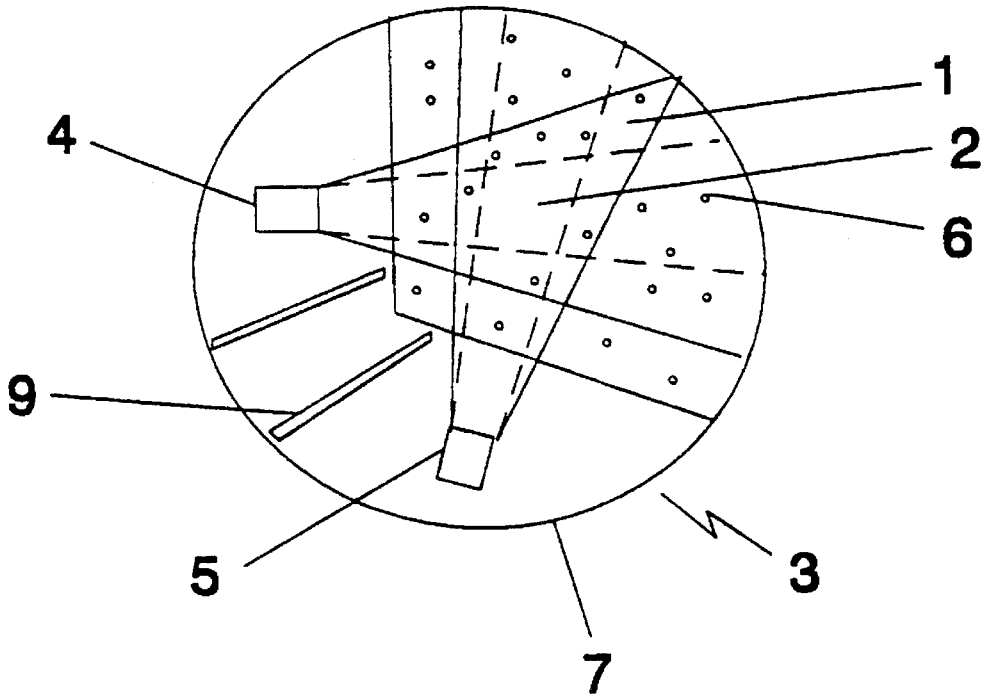
FIG. 3 is a schematic cross section of a scattered-light smoke detector with a test body in the measurement volume, for testing for contamination in accordance with a preferred embodiment of the invention.

A test body 1 as shown in FIG. 3 can be used for testing the degree of contamination of a scattered-light smoke detector 3. In FIG. 3, delimited by broken lines from the light source 4 and from the sensor 5 is the measurement volume 2 of the uncontaminated detector. An enlarged measurement volume of the contaminated detector is delimited by solid lines. A test body 1 of silicone rubber includes aluminum oxide scattering particles having a nominal size of 30 μm, distributed such that the measurement volume 2 of an uncontaminated detector is substantially free of particles. Thus, if the test body is inserted into an uncontaminated detector, no alarm will be triggered. On the other hand, triggering of the alarm indicates enlargement of the measurement volume due to contamination, so that false alarms are likely unless the detector is decontaminated.

For testing, calibration or adjustment, a scattered-light smoke detector is connected to a power supply and to a suitable evaluation device. Depending on the output signal of the scattered-light smoke detector, electronic circuitry in the detector can be adjusted for a specified state. In this fashion, detectors can be adjusted with high accuracy to a specified state such as an alarm state. In the case of a scattered-light smoke detector which does not directly produce an alarm signal but an output signal for transmission to an evaluation center, the technique can be used for adjustment to a specified output signal.

In a preferred embodiment of the technique, the transparent material is silicone rubber, and the included scattering centers are solid particles such as, e.g., aluminum oxide particles, preferably of essentially uniform size and with uniform distribution. Preferred nominal particle size is near 50 μm or less.

In a particularly preferred embodiment, the concentration of included particles is chosen for generated scattered light to meet the alarm criterion of the scattered-light smoke detector. Alternatively, the concentration may correspond to another specified signal.

Instead of solid particles, voids may be included in a transparent material. Such voids, e.g. air bubbles, can function as scattering centers in a fashion similar to solid particles. As the term is used here, "scattering centers" serves to designate any kind of inclusions suitable for light scattering.

The technique can be used further for testing the smoke sensitivity of scattered-light smoke detectors in the field. This involves introducing a test body as described above, including spatially dispersed scattering centers, such that, upon introduction of the test body, at least a portion of the measurement volume is occupied by scattering centers. Preferably, the concentration of the scattering centers is chosen to simulate a smoke density at or above the alarm concentration so that, upon introduction of the test body into the scattered-light smoke detector, triggering of the alarm is expected.

The technique can also be used to ascertain the degree of contamination in scattered-light smoke detectors which have been in use for some time. Typically, as a consequence of such contamination, the measurement volume is enlarged, with spurious scattered light likely to trigger a false alarm. For testing of the degree of contamination, a test body is introduced as described above, but with scattering centers distributed such that the inserted test body is free of scattering centers in the measurement volume of an uncontaminated detector. If the detector is not contaminated to the point where decontamination or cleaning is required, introduction of the test body does not trigger an alarm. If an alarm is triggered, the detector requires decontamination. In this fashion, false alarms can be prevented.

In a preferred manufacture of a transparent test body with scattering centers, aluminum oxide powder particles are mixed with silicone rubber by stirring until the particles are distributed uniformly. This mixture is cast in a mold and hardened, so that the particles are no longer mobile.

Scattered light produced upon irradiation of the test body with light depends on intensity and focussing of the light source and the sensor. The correlation between scattered-light intensity from the test body versus intensity produced by smoke can be determined experimentally, and can then be used as a material constant of the test body.

We claim:

1. A method for adjusting a scattered-light smoke detector having a light source, a measurement volume within range of the light source, and sensor-and-evaluation means disposed for producing a signal depending on light scattered in the measurement volume, the method comprising:

inserting a substantially transparent body including scattering centers into the detector such that the measurement volume is occupied at least in part by the body; and adjusting the detector depending on a resulting signal from the sensor-and-evaluation means.

2. The method of claim 1, wherein adjusting comprises adjusting the sensor-and-evaluation means, for the sensor-and-evaluation means to produce a predetermined signal.

3. The method of claim 2, wherein the predetermined signal is an alarm signal to be produced when the measurement volume comprises smoke having a predetermined density.

4. The method of claim 1, wherein adjusting comprises decontaminating the detector, for the signal from the sensor-and-evaluation means more reliably to depend on light scattered in the measurement volume.

5. A method for testing smoke sensitivity of a scattered-light smoke detector having a light source, a measurement volume within range of the light source, and sensor-and-evaluation means disposed for producing a signal depending on light scattered in the measurement volume, the method comprising:

inserting a substantially transparent body including scattering centers into the detector such that the measurement volume is occupied at least in part by the body, the scattering centers being included in a concentration corresponding to a smoke density at or above an alarm concentration; and sensing a resulting signal from the sensor-and-evaluation means.

6. A method for testing for contamination of a scattered-light smoke detector having a light source, a measurement volume corresponding to an uncontaminated state of the smoke detector and disposed within range of the light source, and sensor-and evaluation means disposed for producing a signal depending on light scattered in the measurement volume, the method comprising:

inserting a substantially transparent body including scattering centers into the detector such that the measurement volume is occupied at least in part by the body, the scattering centers being included in a spatial distribution such that, upon insertion of the body into the smoke detector, the measurement volume is substantially free of scattering centers; and sensing a resulting signal from the sensor-and-evaluation means.

7. A device for adjusting or testing a scattered-light smoke detector, comprising:

a body of substantially transparent material with included scattering centers, shaped for insertion into the detector such that a measurement volume of the detector is occupied at least in part by the body.

8. The device of claim 7, wherein the scattering centers are distributed so as to simulate a predetermined smoke density in said measurement volume of the smoke detector.

9. The device of claim 7, wherein the scattering centers are distributed according to a predetermined spatial distribution.

10. The device of claim 9, wherein the spatial distribution is substantially uniform.

11. The device of claim 7, wherein the scattering centers are sized at least approximately according to a predetermined size distribution.

12. The device of claim 11, wherein the size distribution has a distinctive peak at a desired size.

13. The device of claim 12, wherein the peak is at or near 50 μm or less.

14. The device of claim 7, wherein the scattering centers are solid particles.

15. The device of claim 14, wherein the solid particles consist essentially of aluminum oxide.

16. The device of claim 7, wherein the substantially transparent material consists essentially of silicone rubber.

* * * * *